US005747442A

United States Patent [19]

Bory et al.

[11] Patent Number: 5,747,442

[45] Date of Patent: *May 5, 1998

[54] STICK PRETREATER COMPOSITIONS CONTAINING HYDROPHOBICALLY MODIFIED POLAR POLYMERS

[75] Inventors: Barbara Helen Bory, Fort Lee; Walter Joseph Lunsmann, Whitehouse Station; Dennis Stephen Murphy, Leonia; Tamara Padron; Lucia Victoria Salas, both of North Bergen, all of N.J.

[73] Assignee: Lever Brothers Company, Division of Conopco, Inc., New York, N.Y.

[ * ] Notice: The term of this patent shall not extend beyond the expiration date of Pat. No. 5,719,117.

[21] Appl. No.: 591,750

[22] Filed: Jan. 25, 1996

[51] Int. Cl.[6] ..... C11D 17/00; C11D 3/37

[52] U.S. Cl. ..... 510/475; 510/476; 510/477; 510/281; 510/276; 510/283

[58] Field of Search ..... 510/283, 276, 510/281, 475, 476, 477

[56] References Cited

U.S. PATENT DOCUMENTS

| | | | |
|---|---|---|---|
| 4,203,857 | 5/1980 | Dugan | 252/92 |
| 4,234,627 | 11/1980 | Shilling | 427/242 |
| 4,260,528 | 4/1981 | Fox et al. | 252/528 |
| 4,289,644 | 9/1981 | Steinhauer et al. | 252/127 |
| 4,295,848 | 10/1981 | Sepulveda et al. | 8/139.1 |
| 4,465,619 | 8/1984 | Boskamp | 252/540 |
| 4,472,297 | 9/1984 | Bolich, Jr. et al. | 252/531 |
| 4,491,539 | 1/1985 | Hoskins et al. | 252/541 |
| 4,543,205 | 9/1985 | Contamin | 252/546 |
| 4,556,510 | 12/1985 | Holsopple | 212/547 |
| 4,561,991 | 12/1985 | Herbots | 252/118 |
| 4,576,744 | 3/1986 | Edwards et al. | 252/554 |
| 4,617,148 | 10/1986 | Shields | 252/547 |
| 4,678,606 | 7/1987 | Akhter et al. | 252/542 |
| 4,786,439 | 11/1988 | Ploog et al. | 252/544 |
| 4,788,006 | 11/1988 | Bolich, Jr. et al. | 252/550 |
| 4,877,546 | 10/1989 | Lai | 252/174.17 |
| 4,927,563 | 5/1990 | McCall | 252/557 |
| 5,126,066 | 6/1992 | Torenbeek et al. | 252/95 |
| 5,147,576 | 9/1992 | Montague et al. | 252/174 |
| 5,190,693 | 3/1993 | Mattioli et al. | 252/313.1 |
| 5,232,632 | 8/1993 | Woo et al. | 252/546 |
| 5,254,284 | 10/1993 | Barone et al. | 252/174.15 |
| 5,264,142 | 11/1993 | Hessel et al. | 252/95 |
| 5,286,405 | 2/1994 | Rennie et al. | 252/174.17 |
| 5,308,530 | 5/1994 | Aronson et al. | 252/174.12 |
| 5,336,430 | 8/1994 | Bahary et al. | 252/174.17 |
| 5,366,654 | 11/1994 | Van Den Brom et al. | 252/174.17 |
| 5,384,060 | 1/1995 | Mandy et al. | 252/92 |
| 5,419,848 | 5/1995 | VanEenam | 252/164 |

*Primary Examiner*—Christine Skane
*Assistant Examiner*—Necholus Ogden
*Attorney, Agent, or Firm*—Matthew Boxer

[57] ABSTRACT

The present invention relates to pretreater or compositions in stick form which remove stains. The compositions contain 30 to 80 wt. % of a nonionic surfactant, 1 to about 20 wt. % of an anionic soap, and 0.1% to 10 wt. % of a hydrophobically modified polar polymer. A method of using the composition is also described.

12 Claims, No Drawings

STICK PRETREATER COMPOSITIONS CONTAINING HYDROPHOBICALLY MODIFIED POLAR POLYMERS

FIELD OF THE INVENTION

This invention relates to a pretreater composition in stick form which contains a hydrophobically modified polymer, nonionic surfactants and anionic surfactants.

BACKGROUND OF THE INVENTION

Prewash stain remover compositions for the laundry have been in use for many years. The consumer applies the stain remover to the soiled portions of the garments before washing with a laundry detergent. A convenient application method is by the stick form. However, it is difficult to produce stick forms which have optimal hardness to effectively deliver the pretreater compositions.

Stick versions of such pretreaters are generally aqueous based rather than solvent based and contain both nonionic surfactants and anionic soaps such aqueous based systems, while exhibiting proper hardness characteristics, often compromise cleaning performance (see U.S. Pat. No. 5,147,576 owned by S. C. Johnson.)

Deflocculating polymers which allow incorporation of more surfactants and/or electrolytes in a detergent composition are described in U.S. Pat. No. 5,147,576 issued to Montague.

The polymers of the Montague reference comprise a hydrophilic backbone which is generally a linear branched or highly cross-linked molecular composition containing one or more types of hydrophilic monomer units; and hydrophobic side chains, for example, selected from the group consisting of siloxanes, saturated or unsaturated alkyl and hydrophobic alkoxy groups, aryl and alkylarlyl groups, and mixtures thereof.

These polymers were not, however, taught for use in pretreater compositions, particularly such formulations in stick form.

Although U.S. Pat. No. 5,308,530 does teach the use of these polymers in detergent formulas there is no suggestion or discussion that such combinations would provide improved stick pretreater products.

Thus, there still exists a need in the art for a stable pretreater compositions in stick form based on surfactants and hydrophobically modified polymers which can be directed to penetrate both oil and water based stains for improved cleaning performance.

It is therefore an object of the present invention to provide a stick pretreater composition which provides outstanding cleaning performance on a variety of stains on a variety of fabrics.

Another object of the present invention is to provide such a stick composition which incorporates hydrophobically modified polar polymers for improved cleaning performance.

Another object of the invention is to provide a stick pretreater composition which has an effective hardness profile, is shelf stable and which is free of chelating agents yet does not compromise cleaning performance.

SUMMARY OF THE INVENTION

The compositions of the invention achieve these and other objects and contain from about 0.1 to about 10% by wt. of a hydrophobically modified polar polymer which has a hydrophilic backbone (hydrophilic backbone made of one monomer only, e.g., acrylate) wherein there is a critical molar ratio of hydrophilic groups (e.g., the backbone) to hydrophobic "anchors" attached ("tail") to the backbone, and about 30 wt. % to about 80 wt. % of a nonionic surfactant, and from about 5 wt. % to about 20 wt. % of an anionic soap.

Enzymes and an enzyme stabilizing system are optionally incorporated into the composition for improved cleaning.

DETAILED DESCRIPTION OF PREFERRED EMBODIMENTS

The present invention relates to compositions which may be used as pretreaters in stick form.

The compositions are based on nonionic surfactants and blends of anionic soaps, as well as specific polymers which have a critical molar ratio of a number of hydrophilic "backbone" groups (single monomer hydrophilic backbone) to a number of hydrophobic "anchor" or tail group.

Hydrophobically Modified Polar Polymer

The polymer of the invention is one which, as noted above, has previously been used in structured (i.e., lamellar) compositions such as those described in U.S. Pat. No. 5,147,576 to Montague et al., hereby incorporated by reference into the subject application.

In general, the polymer comprises a "backbone" component which is a monomer (single monomer) as discussed below and a "tail" portion which is a second monomer which is hydrophobic in nature (e.g., lauryl methacrylate or styrene).

The hydrophilic backbone generally is a linear, branched or highly cross-linked molecular composition containing one type of relatively hydrophobic monomer unit wherein the monomer is preferably sufficiently soluble to form at least a 1% by weight solution when dissolved in water. The only limitation to the structure of the hydrophilic backbone is that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight.

The hydrophilic backbone is composed of one monomer unit selected from a variety of units available for polymer preparation and linked by any chemical links including $$-O-,\ -\overset{\overset{\displaystyle O}{\|}}{C}-O,\ -C-C-,\ -C-O-,\ -\overset{\overset{\displaystyle O}{\|}}{C}-N,\ -C-N,\ \text{and}\ -\overset{\overset{\displaystyle O}{\|}}{\underset{\underset{\displaystyle OH}{|}}{P}}- \qquad \text{(I)}$$

The "tail" group comprises a monomer unit comprising hydrophobic side chains which are incorporated in the "tail" monomer. The polymer is made by copolymerizing hydrophobic monomers (tail group comprising hydrophobic groups) and the hydrophilic monomer making up the backbone. The hydrophobic side chains preferably include those which when isolated from their linkage are relatively water insoluble, i.e., preferably less than 1 g/l, more preferred less than 0.5 g/l, most preferred less than 0.1 g/l of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups.

Monomer units which make up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinyl alcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic side chain may be substituted with groups such as amino, amine, amide, sulphonate, sulphate, phosphonate, phosphate, hydroxy, carboxyl and oxide groups.

The hydrophilic backbone is composed of one unit. The backbone may also contain small amounts of relatively hydrophilic units such as those derived from polymers having a solubility of less than 1 g/l in water provided the overall solubility of the polymer meets the requirements discussed above. Examples include polyvinyl acetate or polymethyl methacrylate.

Monomer units useful in the invention have the following formula II

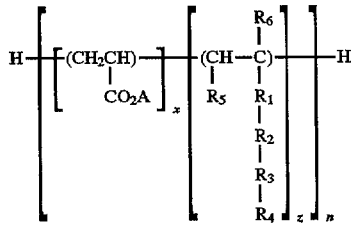

(II)

wherein z is 1;

x:z (i.e., hydrophilic backbone to hydrophobic tail) is less than 20, preferably less than 17, more preferably less than 10;

in which the monomer units may be in random order; and n is at least 1:

$R_1$ represents —CO—O—, —O—, —O—CO—, —$CH_2$—, —CO—NH— or is absent;

$R_2$ represents from 1 to 50 independently selected alkyleneoxy groups preferably ethylene oxide or propylene oxide groups, or is absent, provided that when $R_3$ is absent and $R_4$ represents hydrogen or contains no more than 4 carbon atoms, then $R_2$ must contain an alkyleneoxy group with at least 3 carbon atoms;

$R_3$ represents a phenylene linkage, or is absent;

$R_4$ represents hydrogen or a $C_{1-24}$ alkyl or $C_{2-24}$ alkenyl group, with the provisos a) when $R_1$ represents —O—CO—, $R_2$ and $R_3$ must be absent and $R_4$ must contain at least 5 carbon atoms;

b) when $R_2$ is absent, $R_4$ is not hydrogen and when $R_3$ is absent, then $R_4$ must contain at least 5 carbon atoms;

$R_5$ represents hydrogen or a group of formula —COOA;

$R_6$ represents hydrogen or C1–4 alkyl; and A is independently selected from hydrogen, alkali metals, alkaline earth metals, ammonium and amine bases and $C_{1-4}$.

Alternatively, the group such as,

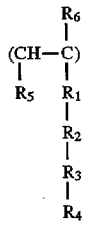

group (defined by z) can be substituted with benzene, for example styrene.

The polymer should be used in an amount comprising 0.01 to 10% by wt., preferably 0.1% to 5% by wt. of the composition.

Nonionic Surfactants

The nonionic surfactants useful in the present invention are those compounds produced by the condensation of alkylene oxide groups with an organic hydrophobic material which may be aliphatic or alkyl or aromatic in nature. The link of the hydrophilic or polyoxyalkylene radical which is condensed with any particular hydrophobic group can be readily adjusted to yield a water soluble compound having the desired degree of balance between hydrophilic and hydrophobic elements. Illustrative, but not limiting examples, of various suitable non-ionic surfactant types are:

(a) polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Also included within this category are nonionic surfactants having a formula:

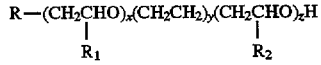

(III)

wherein R is a linear alkyl hydrocarbon radical having an average of 6 to 18 carbon atoms, $R^1$ and $R^2$ are each linear alkyl hydrocarbons of about 1 to about 4 carbon atoms, x is an integer of from 1 to 6, y is an integer of from 4 to 20 and z is an integer from 4 to 25.

Another nonionic surfactant included within this category are compounds of formula:

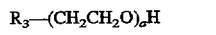

(IV)

wherein $R^3$ is a $C_6$–$C_{24}$ linear or branched alkyl hydrocarbon radical and a is a number from 2 to 50; more preferably $R^3$ is a $C_8$–$C_{18}$ linear alkyl mixture and a is a number from 2 to 15.

(b) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(c) polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitan monostearate, sorbitan monoisostearate, sorbital tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di- or tri-acid esters.

(e) polyoxyethylene-polyoxypropylene block copolymers having formula:

$$HO(CH_2CH_2O)_a(CH(CH_3)CH_2O)_b(CH_2CH_2O)_cH \quad (V)$$

or $$HO(CH(CH_3)CH_2O)_d(CH_2CH_2O)_e(CHCH_3CH_2O)_fH \quad (VI)$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

(f) Alkyl glycosides having formula:

$$R^4O(R^5O)_n(Z^1)_p \quad (VI)$$

wherein $R^4$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^5$ is a divalent hydrocarbon radical containing from 2 to about 4 carbon atoms such as ethylene, propylene or butylene (most preferably the unit $(R^5O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5. Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3. Particularly preferred is APG® 600.

The nonionic surfactant which are most preferred are the polyoxyalkylene condensates of paragraphs "(a)" and "(b)" and the alkyl glycosides. Most preferred are the polyoxyalkylene condensates.

The nonionic is used in an amount of about 30 to about 80 wt. %, preferably 40 wt. % 60 wt. %.

Anionic Soaps

The term "soap" is used herein in its popular sense, i.e., the alkali metal or alkanol ammonium salts of aliphatic alkane- or alkene monocarboxylic acids. Sodium, potassium, mono-, dipand tri-ethanol ammonium cations, or combinations thereof, are suitable for purposes of this invention. In general, sodium soaps are used in the compositions of this invention, but from about 1% to about 25% of the soap may be potassium soaps. The soaps useful herein are the well known alkali metal salts of natural or synthetic aliphatic (alkanoic or alkanoic) acids having about 8 to 22 carbons, preferably about 12 to about 18 carbon atoms. They may be described as alkali metal carboxylates of acrylic hydrocarbons having about 12 to about 22 carbon atoms.

Typical stick form stain remover compositions will comprise about 1–20 wt. %, preferably 5–15 wt. % of normally distributed stearic soap (nominally >95% $C_{18}H_{36}O_2$) as the gelling agent. The current invention preferably uses blends of saturated soaps (carbon chain lengths of $C_8$–$C_{18}$) as the coagel structurant which solidifies the stain treatment sticks. The coagel structuring is used in the margarine industry to solidify oil and water mixtures. A coagel solid relies on the structuring of alternating water and oil bi-layer lamellar sheets to form a macroscopically solid phase. Without being limited to a theory, it is believed that the blend of saturated soaps modifies the surfactant and oil interface in order to form the bi-layer lamellar sheets necessary for the coagel structuring.

The soaps preferably contain saturated or partially saturated fatty acids. Excessive unsaturation should be avoided.

It is preferred to use blends of soaps neutralized (in-situ) from the following table:

| As % of Total Fatty Acid in Formulation | Caprylic $C_8H_{16}O_2$ | Capric $C_{10}H_{20}O_2$ | Lauric $C_{12}H_{24}O$ | Myristic $C_{14}H_{28}O_2$ | Palmitic $C_{16}H_{32}O_2$ | Stearic $C_{18}H_{36}O_2$ | Unsaturated |
|---|---|---|---|---|---|---|---|
| Preferred Range | 0–6.0 | 0–5.0 | 5.0–40.0 | 0–18.0 | 10.0–60.0 | 5.0–60.0 | 0–5.0 |
| Most Preferred | 3.5–5.5 | 3.0–4.8 | 24.5–37.5 | 10.8–15.2 | 17.5–29.5 | 15.2–26.0 | 0–2.8 |

-continued

| As % of Total Fatty Acid in Formulation | Caprylic $C_8H_{16}O_2$ | Capric $C_{10}H_{20}O_2$ | Lauric $C_{12}H_{24}O$ | Myristic $C_{14}H_{28}O_2$ | Palmitic $C_{16}H_{32}O_2$ | Stearic $C_{18}H_{36}O_2$ | Unsaturated |
|---|---|---|---|---|---|---|---|
| Range Example[1] | 0 | 0 | 0 | 0 | 0–5 | 95–100 | 0–2.0 |

[1]as described in U.S. Pat. No. 5,147,576.

The novel benefits of the current invention which uses a blend of saturated soaps and coagel structuring are as follows:

1) When the coagel stick is applied to a stain on cloth and then washed, the mixed saturated soaps helps to avoid a cubic surfactant phase between the stick and the stain in the aqueous phase. A cubic phase is very impermeable which inhibits the transfer of cleaning ingredients and the release of the stain from the cloth. Avoiding this cubic phase by using the blended saturated soaps improves the stain performance on oil stains compared to conventional stain sticks.
2) due to the bi-layer structuring of a coagel stick the dissolution rate in an aqueous solution (i.e., wash liquor) is much greater then with conventional stain sticks. This improves performance and ensures that no treatment stick remains on the cloth after washing.
3) The coagel structurant breaks down under the friction of contact with the cloth. Thus, under the friction of application to a dry stain, the localized region of contact for the coagel stick liquifies. This ensures that the treatment stick is easy to apply, the stick has a user friendly glide texture, and on application the liquified stick formula can penetrate deeper into the stain, removing the stain more completely than with conventional stick formulations.

Formulations containing the preferred blend of saturated soaps may or may not also contain the hydrophobically modified polar polymer of the invention.

Optional Polymers

Conventions Polymers also referred to as antiredeposition polymers may also be incorporated in the formulations of the invention. Such polymers include polycarboxylates (e.g. copolymers of acrylate/maleate commercially available as Sokolan® copolymers supplied by BASF); polyoxyalkylene copolymers (e.g. Pluronic Series supplied by BASF); carboxymethylcelluloses (e.g. CMC Series supplied by Union Carbide); methylcellulose (e.g. Methocel from Dow Chemical) and ethoxylated polyamines (e.g. ethoxylated tetra ethylene pentamine from Shell Chemical Co).

Especially preferred are the polycarboxylate polymers. The polymers should be incorporated in the formulations of the invention in an amount of up to about 5 wt. %, preferably 0.1 wt. % to 3 wt. %, most preferably 0.5 wt. % to 1 wt. %.

Enzymes

Enzymes may optionally be included in the pretreater formulations to enhance the removal of soils from fabrics. If present, the enzymes are in an amount of from about 0 to 10 weight %, preferably 1 to about 5 wt. %. Such enzymes include proteases (e.g. Alcalase®, Savinase® and Esperase® from Novo Industries A/S), amylases (e.g. Termamyl® from Novo Industries A/S), lipolases (e.g. Lipolase® from Novo Industries A/S) and cellulases, (e.g. Celluzyme® from Novo Industries A/S).

Enzyme Stabilizing System

Stabilizers or stabilizer systems may be used in conjunction with enzymes and generally comprise from about 1 to 15% by weight of the composition.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate.

A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propanediol which is preferred), ethylene glycol, glycerol, sorbitol, mannitol and glucose. The polyol generally represents from about 0.5% to about 15%, preferably from about 1.0% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g. sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One especially preferred stabilization system is a polyol in combination with boric acid. Preferably, the weight ratio of polyol to boric acid added is at least 1, more preferably at least about 1.3.

Preparation of Formulations

The formulations of the invention are prepared as follows, but may be prepared in any form known in the art for stick forms.

The fatty acid(s) used are typically neutralized to soap in-situ. The nonionic surfactant, the blend of fatty acid(s) and the polyols such as sorbital, glycerol, propylene glycol are heated to about 70° F. to form a homogeneous melt mixture. Water and neutralizing base (typically caustic) are then added to neutralize the fatty acid(s). The polymer is then added and mixed until the mixture is homogeneous. The homogenous mixture is than cooled to just above the mixtures dripping point. Any heat labile additional ingredients (i.e., enzymes, fragrance, preservatives) are then added. The composition is then packaged, cooled and stored.

Alternatively, the initial melt mixture can be added to a premixed mixture of water, caustic and polymer to perform the in-situ neutralization.

Antifoam

Optionally, an antifoam agent may be incorporated into the formulations in an amount of up to 2 wt. %, preferably 0.05 to 1 wt. %, to reduce the level of air entrapped in the solidified sticks. Suitable antifoams include mono- and distearyl acid phosphate, silicone oil, silicon emulsion, silicon compounds and mineral oil. Preferably, silicon emulsions are used.

Optional Ingredients

One or more optional additives may be included in the formulations including perfumes, dyes, pigment, opacifiers, germicides, optical brighteners, anticorrosional agents and preservatives. Each preservative incorporated in the composition should be present in an amount of up to about 0.5% by wt.

The following examples will serve to distinguish this invention from the prior art and illustrate its embodiments more fully. Unless otherwise indicated, all parts, percentages and proportions referred to are by weights.

EXAMPLE I

A stick formulation according to the invention was prepared as Sample A below. As a comparison, an aqueous pretreater formulation without the selected hydrophobically modified polymer was prepared as Sample B.

TABLE 1

| Ingredient | Samples A | Samples B |
|---|---|---|
| propylene glycol | 11.0 | 11.0 |
| alcohol ethoxylate[2] | 57.9 | 57.9 |
| Narlex ® DC-1[3] | 0.3 | 0 |
| stearic acid[4] | 4.4 | 4.4 |
| coconut fatty acid[5] | 7.9 | 7.9 |
| sodium hydroxide | 2.1 | 2.1 |
| deionized water | to 100% | |

[2]a nonionic surfactant having 12–15 carbon atoms in the hydrophobic group and 9 EOs and supplied as Neodol 25-9 by Shell Chemical Co.
[3]a copolymer of acrylic acid and lauryl methacrylic acid supplied by National Starch and Chemical Co.
[4]stearic acid containing a mixture of $C_{12-18}$ saturated fatty acids supplied as Emersol 132 by Henkle.
[5]partially hydrogenated coconut fatty acid $C_8$–$C_{22}$ saturated fatty acids supplied by Henkle.

The nonionic surfactant, the anionic surfactant, the polymer and the propylene glycol were added together in a mixture with low to medium agitation. The batch was heated up 40° C. The fatty acid was then added and heating was continued until the batch reached 55° C. Once the fatty acid was completely melted, the water was added with heating to maintain the batch at 50°–55° C. Once the batch was homogeneous, the sodium hydroxide was added. The batch was then mixed for 45 minutes to ensure full neutralization of the fatty acid. The batch was then cooled to 50° C. The batch was then placed in a package and allowed to air cool with chilling.

EXAMPLE II

The stain removal performance of the inventive composition (Sample A) versus Sample B without the selected polymer was evaluated on three (3) different stains and on three types of fabric as follows.

The three types of test cloths used to evaluate the compositions were:

1) 100% cotton
2) 50%/50% polyester/cotton blend
3) double knit 100% polyester

Cloths 1 and 2 were obtained from Textile Innovators (Windsor, N.C.), and the polyester cloth 3 was obtained from Test Fabrics (Middlesex, N.J.). Prior to staining, the cloths were prewashed 5 times in Dye Free Liquid "all" at 130° F. (and dried) to remove spinning oils and increase the absorbency of the cloth. Swatches were cut to 4¾"×8¾", and a 2" diameter circle inscribed in the middle.

Three different stains were used as follows:

1) Grass (100 g grass clippings added to 200 g water, blended, filtered through cotton ballast, 100 g more clippings and 200 g more water added to filtrate,and new mixture filtered).
2) Cooking Oil/Food Colorant (17 gms. of annato seed colorant are dissolved in 400 gms. of cooking oil and the mixture is passed through a cheese cloth filter).
3) Mud (strained dirt mixed 1:1 with water and blended).

The stains were applied over the 2" circle on each swatch as outlined in Table 2:

TABLE 2

| Stain | Dosage Cotton | Dosage Blend | Dosage Polyester | Treatment |
|---|---|---|---|---|
| mud | ⅛ tsp | ⅛ tsp | ¼ tsp | overnight |
| grass | 8 drops (2×) | 8 drops (2×) | ¼ tsp. | overnight |
| cooking oil/food colorant | 12 drops | 12 drops | — | overnight |

The stain cloth were pretreated (by rubbing) with the stick. Application of the stick is done using minimal force, allowing the natural gliding tendency of the stick to drive the movement. The stained and treated clothes were allowed to sit for 5 minutes before washing. The washes were done using the recommended dosages of a laundry liquid detergent in warm, 95° F. water and rinsed in cold water. The cloths were then placed in a static dryer until dry. Four replicates of each stain with each cloth were performed.

Stain removal was measured by reflectometry and color change using a Pacific Scientific Colorgard System model 5 colorimeter. The stain removal index (SRI) gives a numerical value for stain removal and is defined as:

$$SRI=100-[(L_c-L_w)^2+(a_c-a_w)^2+(b_c-b_w)^2]^{1/2}$$

Where:

L=measured lightness (reflectance) value a=measured greenness/redness value b=measured blueness/yellowness value c=clean cloth w=stained and washed cloth Stain removal data for Samples A and B for the three stains on the three types of cloth were observed and are reported in Table 3 below:

TABLE 3

| Stain | Stain Removal Index Values | | | | | | | | |
|---|---|---|---|---|---|---|---|---|---|
| | 100% Cotton | | | 50/50 Polyester/Cotton | | | 100% Polyester | | |
| Stain | A | B | LSD | A | B | LSD | A | B | LSD |
| Mud | 74.49 | 72.63 | 1.08 | 78.52 | 77.38 | 1.53 | 94.91 | 94.50 | 0.39 |
| Grass | 88.82 | 88.7 | 1.66 | 93.56 | 93.45 | 0.34 | 96.21 | 96.94 | 0.71 |
| Cooking Oil/ Food Colorant | 90.59 | 90.41 | 1.12 | 92.05 | 91.29 | 0.27 | N/A | N/A | N/A |

LSD = Least Significant Difference at 95% confidence level.

It was thus observed that the inventive Sample A consistently gave directionally better stain removal than observed with Sample B which did not contain the selected polymer.

EXAMPLE III

Stick forms of the inventive formulation incorporating a styrene containing acrylic acid copolymer were prepared as described in Example 1 and presented in Table 4 below:

TABLE 4

| Ingredient | % Active |
|---|---|
| propylene glycol | 11.0 |
| alcohol ethoxylate[1] | 57.9 |
| ALCO EXP 2499[2] | 0.5 |
| stearic acid[3] | 4.4 |
| coconut fatty acid[4] | 7.9 |
| sodium hydroxide | 2.1 |
| deionized water | to 100% |

[1]a nonionic surfactant supplied by Shell as Neodol 25-9.
[2]a styrene containing acrylic acid copolymer supplied by Alco under the Series H100.
[3]stearic acid containing a mixture of $C_{12-18}$ saturated fatty acids supplied as Emersol 132 by Henkle.
[4]partially hydrogenated coconut fatty acid $C_8$–$C_{22}$ saturated fatty acids supplied by Henkle.

We claim:

1. A stick pretreater composition comprising surfactants:
a) about 30 to about 80 wt. % of a nonionic surfactant;
b) about 1 to about 20 wt. % of an anionic soap having an unsaturation range of from 0 to 5% based on the total fatty acid in the composition, the anionic soap selected from the group consisting of an alkali metal or alkanol ammonium salt of aliphatic alkane- or alkene monocarboxycilic acids and mixtures thereof; and
c) 0.1% to 10% by wt. of a polymer having
1) a hydrophilic backbone comprising a polymer of a nonionic unit selected from from the group consisting of
i) one or more ethylenically unsaturated non-cyclic hydrophilic monomers selected from the group consisting of unsaturated $C_{1-6}$ acids, ethers, alcohols, aldehydes, ketones or esters;
ii) one or more polymerizable hydrophilic cyclic monomer units,
iii) one or more non-ethylenically unsaturated polymerizable hydrophilic monomers selected from the group consisting of glycerol and other polyhydric alcohols, and
iv) mixtures thereof,
wherein said polymer is optionally substituted with one or more amino, amine amide, sulphonate, sulphate, phosphonate, hydroxy, carboxyl or oxide groups to specify one monomer only and
2) a tail comprising monomers having pendant hydrophilic groups and pendent hydrophobic groups,
said polymer having a MW of 1,000 to 20,000, wherein the molar ratio of backbone hydrophilic group to pendant hydrophobic group is less than 20.

2. A composition according to claim 1 wherein the anionic soap is an alkali metal salt of an aliphatic acid having about 8 to about 22 carbon atoms.

3. A composition according to claim 2 wherein the alkali metal soap is a mixture of saturated fatty acids.

4. A composition according to claim 1 having the formula:

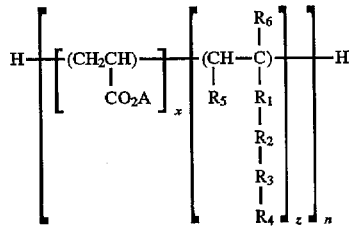

(II)

wherein
z is 1;
x:z is less than 20
n is at least 1
$R^1$ represents —CO—O—, —O—, —O—CO—, —$CH_2$—, —CO—NH— or is absent;
$R^2$ represents from 1 to 50 independently selected alkyleneoxy groups preferably ethylene oxide or propylene oxide groups, or is absent, provided that when $R^3$ is absent and $R^4$ represents hydrogen or contains no more than 4 carbon atoms, then $R^2$ must contain an alkyleneoxy group with at least 3 carbon atoms;
$R^3$ represents a phenylene linkage, or is absent;
$R^4$ represents hydrogen or a $C_{1-24}$ alkyl or $C_{2-24}$ alkenyl group, with the provisos that
a) when $R^1$ represents —O—CO—, $R^2$ and $R^3$ must be absent and $R^4$ must contain at least 5 carbon atoms;
b) when $R^2$ is absent, $R^4$ is not hydrogen and when $R^3$ is absent, then $R^4$ must contain at lest 5 carbon atoms;
$R^5$ represents hydrogen or a group of formula —COOA;
$R^6$ represents hydrogen or $C_{1-4}$ alkyl; and
is independently selected from hydrogen, alkali metals, alkaline earth metals, ammonium and amine bases and $C_{1-4}$,
wherein the monomer units may be in random order.

5. A composition according to claim 1, wherein the backbone monomer is acrylate and the monomer comprising hydrophobic pendant group is lauryl methacrylate.

6. A composition according to claim 1, wherein molar ratio is less than 17.

7. A polymer according to claim 1, wherein molar ratio is less than 10.

8. A composition according to claim 1 wherein the composition further comprises: 0.01–0.5% by weight of an antifoam agent.

9. A method of pretreating stained fabrics with a stick product before a wash cycle is initiated comprising the steps of:
applying a pretreater composition in stick form to a stained fabric, the composition comprising:
a) about 0.1 to about 20 wt. % of a nonionic surfactant;

b) about 1 to about 20 wt. % of an anionic soap having an unsaturation range of from 0 to 5% based on the total fatty acid in the composition, the anionic soap selected from the group consisting of an alkali metal or alkanol ammonium salt of aliphatic alkane- or alkene monocarboxycilic acids and mixtures thereof; and c) 0.1% to 10% by wt. of a polymer having 1) a hydrophilic backbone comprising a polymer of a nonionic unit selected from the group consisting of i) one or more ethylenically unsaturated non-cyclic hydrophilic monomers selected from the group consisting of unsaturated $C_{1-6}$ acids, ethers, alcohols, aldehydes, ketones or esters;

ii) one or more polymerizable hydrophilic cyclic monomer units;

iii) one or more non-ethylenically unsaturated polymerizable hydrophilic monomers selected from the group consisting of glycerol and other polyhydric alcohols, and iv) mixtures thereof, wherein said polymer is optionally substituted with one or more amino, amine amide, sulphonate, sulphate, phosphonate, hydroxy, carboxyl or oxide groups to specify one monomer only, and 2) a tail comprising monomers having pendant hydrophilic groups and pendent hydrophobic groups, said polymer having a MW of 1,000 to 20,000, wherein the molar ratio of backbone hydrophilic group to pendant hydrophobic group is less than 20 to effectively remove stains from fabrics.

10. A method according to claim 9 wherein the anionic soap is an alkali metal salt of an aliphatic acid having about 8 to about 22 carbon atoms.

11. A method according to claim 10 wherein the alkali metal soap is a mixture of saturated fatty acids.

12. A polymer according to claim 9 having the formula:

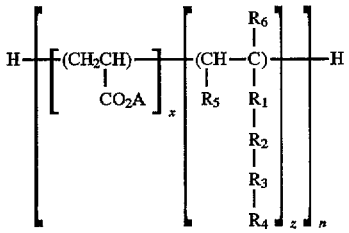

(II)

wherein z is 1;

x:z is less than 20 n is at least 1

$R^1$ represents —CO—O—, —O—, —O—CO—, —$CH_2$—, —CO—NH— or is absent;

$R^2$ represents from 1 to 50 independently selected alkyleneoxy groups preferably ethylene oxide or propylene oxide groups, or is absent, provided that when $R^3$ is absent and $R^4$ represents hydrogen or contains no more than 4 carbon atoms, then $R^2$ must contain an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisos that a) when $R^1$ represents —O—CO—, $R^2$ and $R^3$ must be absent and $R^4$ must contain at least 5 carbon atoms;

b) when $R^2$ is absent, $R^4$ is not hydrogen and when $R^3$ is absent, then $R^4$ must contain at lest 5 carbon atoms;

$R^5$ represents hydrogen or a group of formula —COOA;

$R^6$ represents hydrogen or $C_{1-4}$ alkyl; and is independently selected from hydrogen, alkali metals, alkaline earth metals, ammonium and amine bases and $C_{1-4}$, wherein the monomer units may be in random order.

* * * * *